US005177493A

United States Patent [19]

Kawamura

[11] Patent Number: 5,177,493

[45] Date of Patent: Jan. 5, 1993

[54] ANTENNA DEVICE FOR MOVABLE BODY

[75] Inventor: Katsuaki Kawamura, Kawagoe, Japan

[73] Assignee: Pioneer Electronic Corporation, Tokyo, Japan

[21] Appl. No.: 663,334

[22] Filed: Mar. 1, 1991

[30] Foreign Application Priority Data

| | | | |
|---|---|---|---|
| Mar. 5, 1990 | [JP] | Japan | 2-52996 |
| Mar. 5, 1990 | [JP] | Japan | 2-52997 |
| Mar. 5, 1990 | [JP] | Japan | 2-52998 |
| Mar. 5, 1990 | [JP] | Japan | 2-52999 |

[51] Int. Cl.[5] ..... H01Q 1/32

[52] U.S. Cl. ..... 343/713; 343/715; 343/879

[58] Field of Search ..... 343/713, 715, 711, 900, 343/893, 700 MS File, 879, 889, 888, 853, 876

[56] References Cited

U.S. PATENT DOCUMENTS

| | | | |
|---|---|---|---|
| 2,163,471 | 6/1939 | Sharp | 343/713 |
| 4,253,099 | 2/1981 | Yamazaki et al. | 343/713 |
| 4,254,419 | 3/1981 | Noddin | 343/715 |
| 4,788,551 | 11/1988 | Ishida | 343/713 |

*Primary Examiner*—Rolf Hille
*Assistant Examiner*—Hoanganh Le
*Attorney, Agent, or Firm*—Sughrue, Mion, Zinn, Macpeak & Seas

[57] ABSTRACT

An antenna device for a movable body such as automobile comprises a base member to be attached substantially horizontally to the movable body, a plurality of horizontal antenna elements for receiving electric wave attached horizontally to the base member and a plurality of vertical antenna elements for receiving electric wave attached upright to the base member. The horizontal antenna elements are substituted with a defogger provided for the rear window of the automobile. The horizontal and vertical antenna elements are electrically connected, through terminal members attached to the base member, to a switching circuit for selectively switching ones of the vertical and horizontal antenna elements. The vertical antenna elements are accommodated, when unused, in grooves formed to the upper surface of the base member and an engaging mechanism is disposed in the groove so as to firmly support the accommodated vertical antenna element in a disengageable manner.

21 Claims, 10 Drawing Sheets

ANTENNA DEVICE FOR MOVABLE BODY

BACKGROUND OF THE INVENTION

The present invention relates to an antenna device to be equipped to a movable body such as an automobile for receiving electric waves.

An automobile is generally equipped with an audio system such as car radio or car stereo system and, recently, a car television system or car telephone is also equipped. Furthermore, a global positioning system (GPS) as a satellite orbit utilizing system which determins a present position of a moving body by receiving an electric wave from an artificial satellite has come into practical use and, in certain cases, such GPS is equipped for a movable body such as an automobile or a craft.

In a case where such equipment is provided for the movable body to receive or transmit the electric wave, a fading phenomenon may be caused in accordance with the movement of the movable body, and in order to reduce the influence of the fading, it will be necessary to perform a diversity receiving process, which is a method in which more than two kinds of receiving signals having identical modulation signals and informations and having different signal-to-noise ratios at an optional instance are utilized selectively or in combination thereby to obtain receiving signals to be demodulated. It is therefore necessary to locate a plurality of antenna device capable of receiving different electric waves respectively for receiving signals by the utilization of such diversity receiving methods.

For example, with respect to a conventional antenna device for a car radio system equipped with an automobile, a rod antenna element is attached in a standing manner at a rear portion of the automobile and a defogger provided for a rear window is commonly utilized as an antenna element. In particular, the diversity signal receiving is carried out by the defogger arranged substantially horizontally and the rod antenna element, and a switching circuit is also equipped for selectively switching the rod antenna element and the defogger for receiving the electric wave from selected one of these antenna elements in good condition. The signal selected by the switching circuit is then tuned by a tuner and, thereafter, amplified by an amplifier. Thus, the signal is outputted as a sound through a speaker.

However, in the conventional antenna device, since one rod antenna element and a defogger, as a horizontal antenna element, are utilized in combination as an antenna device, it is difficult to always receive an electric wave in good condition by selectively utilizing the switching circuit. Moreover, there is a problem for preliminarily setting the antenna characteristics of the rod antenna element and the defogger, respectively.

In another aspect, as described before, the GPS as a satellite orbit utilizing system which determines a present position of a moving body by receiving an electric wave from an artificial satellite has come into practical use and, in a certain case, such GPS is equipped for a movable body such as an automobile or a craft. Furthermore, there is a problem of the conventional antenna device in which the rod antenna element attached in a standing manner from the automobile, for example, may be broken or folded by mischief at a time when the car is parked.

SUMMARY OF THE INVENTION

A primary object of the present inention is to substantially eliminate defects or drawbacks encountered in the prior art and to provide an antenna device for a movable body capable of achieving good electric wave receiving condition in response to an electric wave condition to be received and being easily attached to the movable body such as an automobile.

Another object of the present invention is to provide an antenna device for a movable body including an antenna element for a global positioning system for receiving an electric wave for achieving more improved wave receiving condition.

A further object of the present invention is to provide an antenna device for a movable body including a plurality of vertical antenna elements which are arranged so as to be prevented from being broken or bent by accommodating them in grooves formed to a base member which is attached to the movable body and capable of achieving a stable moving condition of the movable body.

A still further object of the present invention is to provide an antenna device for a movable body including a plurality of horizontal and vertical antenna elements with suitable positional relationship and including a switching circuit means for selectively switch ones of the horizontal and vertical antenna elements in response to an electric wave condition.

A still further object of the present invention is to provide an antenna device for a movable body capable of firmly engaging the vertical antenna element bent in the groove formed to the base member and easily disengaging the same.

These and other objects of the present invention can be achieved, in one aspect, by providing an antenna device for a movable body such as automobile, comprising a base member to be attached substantially horizontally to the movable body, a plurality of horizontal antenna elements for receiving electric wave attached horizontally to the base member and separated with each other by a predetermined distance, a plurality of vertical antenna elements for receiving electric wave attached upright to the base member and separated with each other by a predetermined distance, electric terminal members attached to the base member and electrically connected to the horizontal and vertical antenna elements, respectively, and a switching circuit means electrically connected to the terminal members for selectively switching ones of the vertical and horizontal antenna elements.

According to the antenna device of the characters described above, a plurality of horizontal and vertical antenna elements are arranged to the base member with predetermined spaces, so that the electric wave can be received in good condition by selectively switching between the vertical and horizontal antenna elements in response to the wave condition even if the wave condition be changed in accordance with the movement of the movable body.

In a preferred embodiment or a modification, the antenna device is provided with an antenna element for the global positioning system for receiving the wave from the artificial satellite, the antenna element being disposed at substantially the central portion of the base member in a horizontally extending attitude, so that the electric wave from the artificial satellite can be also received.

When the base member is formed by a spoiler attached to the automobile and grooves are formed on the upper surface of the spoiler, the vertical antenna elements can be accommodated in the grooves by falling them down therein when unused.

In another aspect of the present invention, there is provided an antenna device for a movable body comprising a base member to be attached substantially horizontally to the movable body, the base member being formed of a non-conductive material and being provided with grooves to an upper surface thereof, a vertical anatenna element for receiving electric wave attached substantially upright to the base member and accommodated in the grooves formed in the base member when unused, and electric terminal members attached to the base member and electrically connected to the vertical antenna element. In this aspect, the movable body is an automobile and the base member has a shape suitable for generating a resisting force to force downward an automobile body during a running of the automobile. The automobile is provided with a rear window to which is mounted a defogger acting as a horizontal antenna element for receiving electric wave, and the antenna device further comprises a switching circuit means electrically connected to the vertical antenna element and the defogger for selectively switching one of the vertical antenna element and the defogger in response to the electric wave receiving condition.

According to the characters of this embodiment, the electric wave received by the vertical antenna element is transmitted to the electric terminal member attached to the spoiler made of non-conductive material and then to the signal processing circuit. The vertical antenna element is accommodated in the groove formed to the upper surface of the spoiler when unused and set upright therefrom when used. The spoiler may be constructed so as to have a shape suitable for causing the resisting force for pressing down the automobile against the ground of the earth during the running thereof, so that the running stability of the automobile can be realized.

In a more specific aspect of the present invention, there is provided an antenna device for an automobile provided with a trunk lid, the device comprising a spoiler of non-conductive property attached horizontally to the trunk lid of the automobile, the spoiler being provided with a pair of grooves formed to an upper surface thereof, each of the grooves having both longitudinal end portions in a level lower than that of a central portion thereof so as to provide a curved shape, a pair of horizontal antenna elements for receiving electric wave embedded in the spoiler so as to extend longitudinally horizontally with respect to the spoiler, a pair of vertical antenna elements for receiving an electric wave attached upright to the spoiler at portions near outer ends of the embedded horizontal antenna elements, the vertical antenna elements being accommodated in the grooves formed to the spoiler when unused, each of said vertical antenna elements having a flexible property so as to provide a linearly straight shape at a time of receiving no external force, a pair of engaging mechanisms each being disposed in each of the grooves for engaging the vertical antenna element in a flexed manner in a disengageable manner, each of the engaging mechanisms comprising a U-shaped outer portion constituting a portion of the groove and secured to a rear side of an upper surface of the spoiler, and an engaging member disposed in the spoiler for engaging a front end portion of the vertical element fallen down in the U-shaped portion in a disengageable manner. The vertical movement of the engaging member is limited and the engaging member is allowed to move in a direction substantially normal to the vertical antenna element by inserting a key member into a key hole provided for the spoiler. The engaging member is urged by a spring member in a direction to close the portion of said groove. The terminal members are also secured to the spoiler and electrically connected to the horizontal and vertical antenna elements. There may be further provided with an antenna element for a global positioning system for receiving an electric wave embedded in substantially a central portion of the spoiler so as to extend horizontally with respect to a ground of the earth, a terminal member is secured to the spoiler and electrically connected to the antenna element for the global positioning system, and a switching cicuit means electrically connected to the terminal members for selectively switching ones of the horizontal and vertical antenna elements in response to wave receiving condition.

According to the characters of this embodiment, the electric wave received by the vertical antenna element is transmitted to the terminal member attached to the spoiler, as the base member, having non-conductive property, and then to the signal processing circuit. The vertical element can be accommodated in the groove formed to the upper surface of the spoiler when unused and is set upright when used. When the vertical antenna element is accommodated in the groove, the antenna element is supported in a flexed state by the engaging mechanism disposed in the spoiler, thus being firmly supported therein.

DESCRIPTION OF THE PREFERRED EMBODIMENTS

Figure 1:
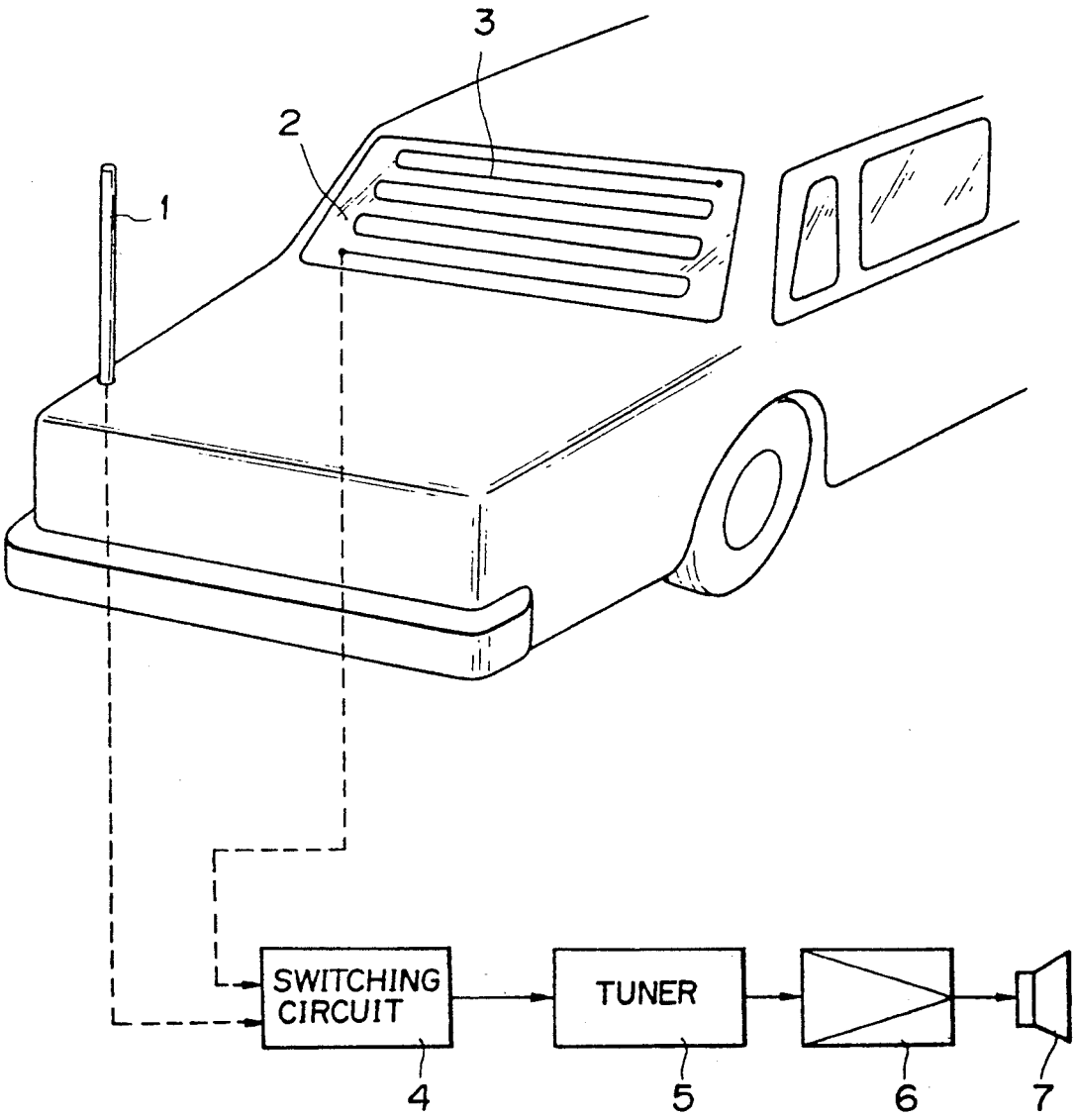
FIG. 1 PRIOR ART
FIG. 1 is a partial perspective view of an automobile to which a conventional antenna device is attached.

For a better understanding of the present invention, a conventional antenna device for a movable body such as an automobile is first described hereunder with reference to FIG. 1, showing a schematic view of an automobile provided with a car radio system including a circuit elements and an antenna device.

Referring to FIG. 1, a rod antenna element 1 is attached in a standing manner at a rear portion of the automobile and a defogger 3 provided for a rear window 2 is commonly utilized as an antenna element. Namely, the diversity signal receiving is carried out by the defogger 3 arranged substantially horizontally and the rod antenna element 1, and a switching circuit 4 is also equipped for selectively switching the rod antenna element 1 and the defogger 3 for receiving the electric wave from selected one of these antenna elements 1 and 3 in good condition. The signal selected by the switching circuit 4 is then tuned by a tuner 5 and, thereafter, amplified by an amplifier 6. Thus, the signal is outputted as a sound through a speaker 7.

However, the conventional antenna device of the structure described above has defects or drawbacks described hereinbefore.

The present invention conceived for overcoming the described defects of the conventional antenna device will be described hereunder with reference to FIGS. 2 to 16.

Figure 2:
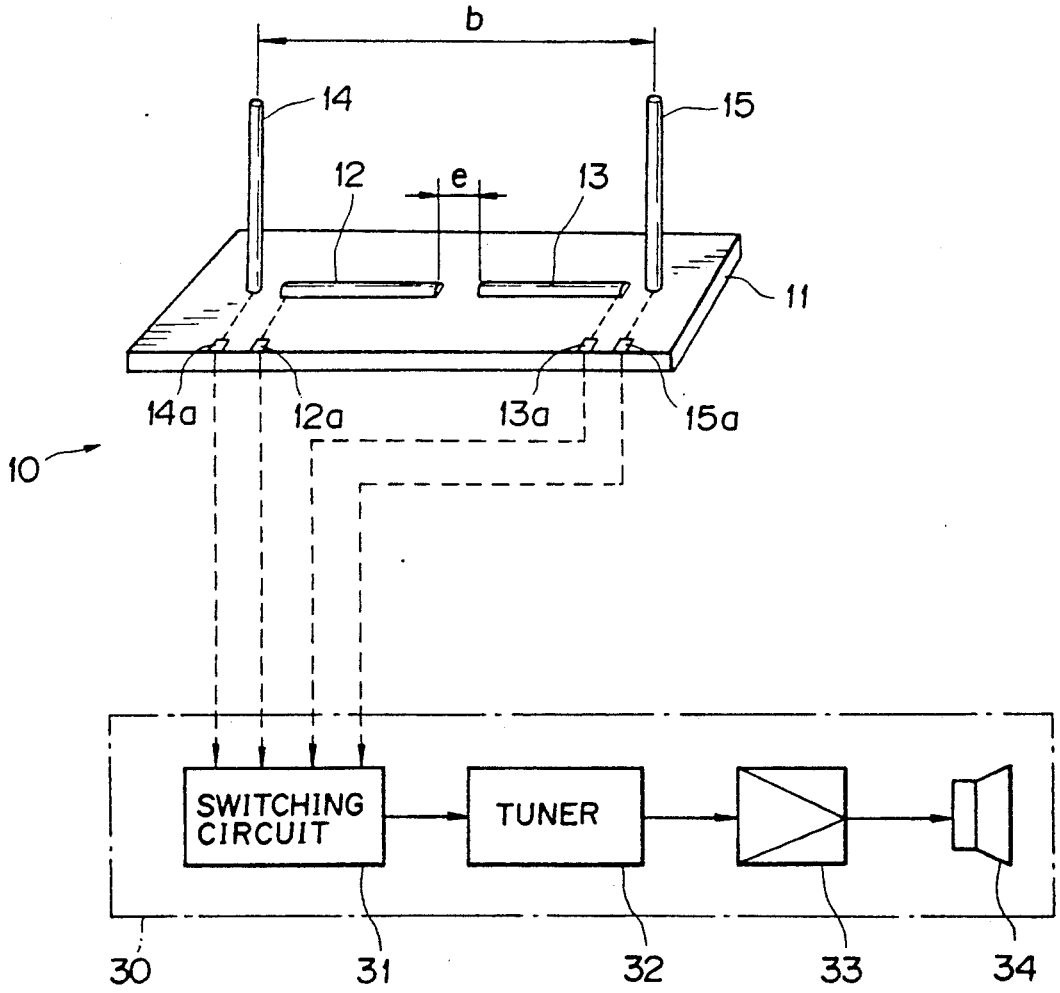
FIG. 2 shows a schematic construction of a first embodiment of an antenna device according to the present invention.

First, referring to FIG. 2, reference numeral 10 generally designates an anttena device according to one embodiment of the present invention, which is to be equipped to a movable body such as an automobile or a craft. An electric wave received by the antenna device 10 as a receiving signal is processed by inputting it into a signal processing circuit 30.

The antenna device 10 is provided with a base member 11 of non-conductive property is attached to the movable body with its longitudinal direction being directed horizontally. A pair of horizontal antenna elements 12 and 13 for receiving the electric waves are horizontally arranged on the upper surface of the base member 11 in a row with a predetermined space of e. A pair of vertical antenna elements 14 and 15 for also recieving the electric wave are arranged upright at portions slightly apart from respective outer ends of the horizontal antenna elements 12 and 13 with a predetermined space of b. Electric terminal pieces 12*a*, 13*a*, 14*a* and 15*a* electrically connected respectively to the horizontal and vertical antenna elements 12, 13, 14 and 15 are secured to the end edge of the base member 11.

According to such structure of the antenna device 10, the electric wave received by the respective antenna elements 12 to 15 are transmitted to a switching circuit 31 through the corresponding terminal pieces as electric signals. The switching circuit 31, after receiving the signals, operates to select ones of the horizontal and vertical elements in response to the signal receiving condition. The signal selected by the switching circuit 31 is tuned by a tuner 32, amplified by an amplifier 33 and then outputted as a sound through a speaker 34.

Figure 3:
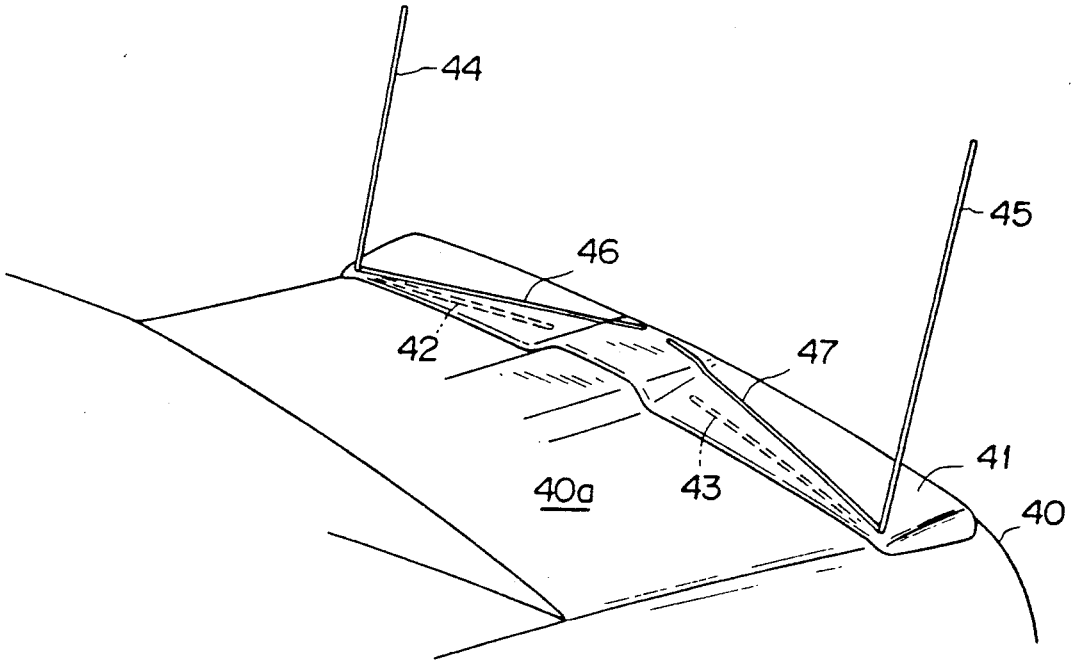
FIG. 3 is a partial perspective view of an automobile to which the antenna device of FIG. 2 is attached.

FIG. 3 shows an application of the embodiment of FIG. 2, in which an antenna device utilizes an air spoiler or stabilizer 41 as a base member, called merely a spoiler, of non-conductive property attached to a trunk lid 40*a* of an automobile 40 as a movable body. Referring to FIG. 3, according to this example, a pair of horizontal antenna elements 42 and 43 for receiving the electric wave are embedded in the spoiler 41 so as to extend in the longitudinal direction thereof, and a pair of vertical antenna elements 44 and 45 for receiving the electric wave are disposed in a standing manner from the spoiler 41 at portions slightly apart from the outer ends of the horizontal antenna elements 42 and 43. These vertical antenna elements 44 and 45 can be accommodated in grooves 46 and 47 formed longitudinally on the upper surface of the spoiler 41. Accordingly, the vertical antenna elements 44 and 45 can be accommodated in the grooves 46 and 47 when unused and set upright when used as shown in FIG. 3. The vertical antenna elements 44 and 45 may be formed of a stainless member having an elastic property for improving the stability during a high speed running of the automobile as well as attaining a good wave receiving ability.

It is to be noted that the number of the horizontal and vertical antenna elements are not limited to two, and a plurality of antenna elements may be utilized in substantilly the same manner.

According to the first embodiment of the antenna device of the present invention, a plurality of vertical and horizontal antenna elements are attached to the base member so as to be switched by the switching circuit in response to the wave receiving condition, so that the characteristic values of the respective antenna elements required at a time of diversity wave receiving operation can be preliminarily set to suitable values, thus receiving and transmitting the signal always in good condition by switching the antenna elements even if the condition of the electric wave be changed in accordance with the running direction of the movable body.

Figure 4:
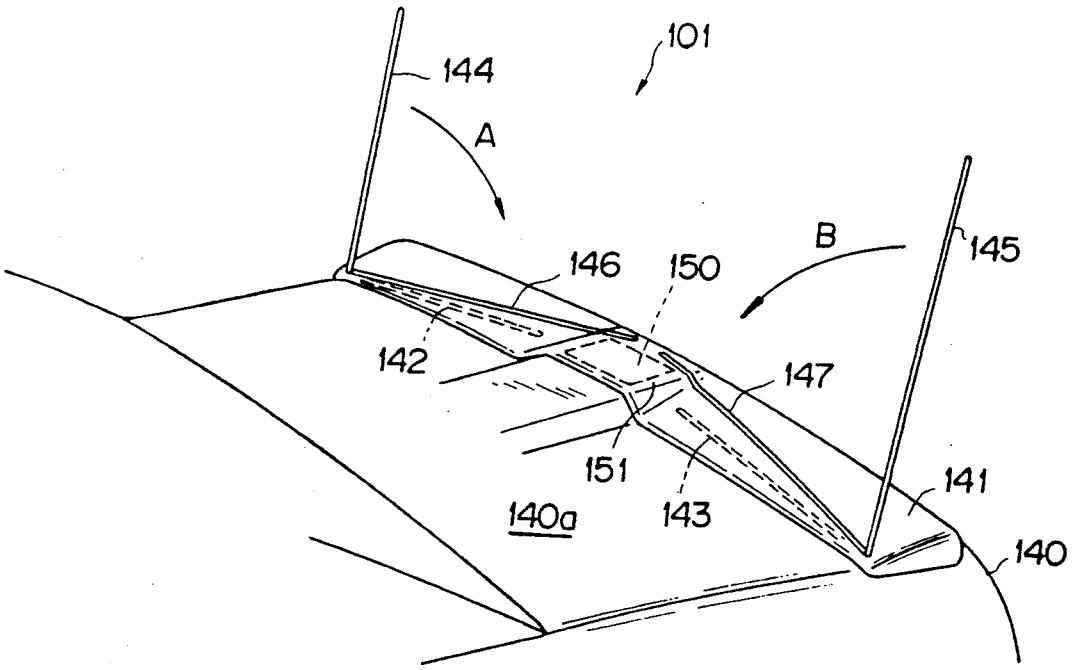
FIG. 4 is a view similar to that of FIG. 3, showing a second embodiment of an antenna device according to the present invention.
Figure 5:
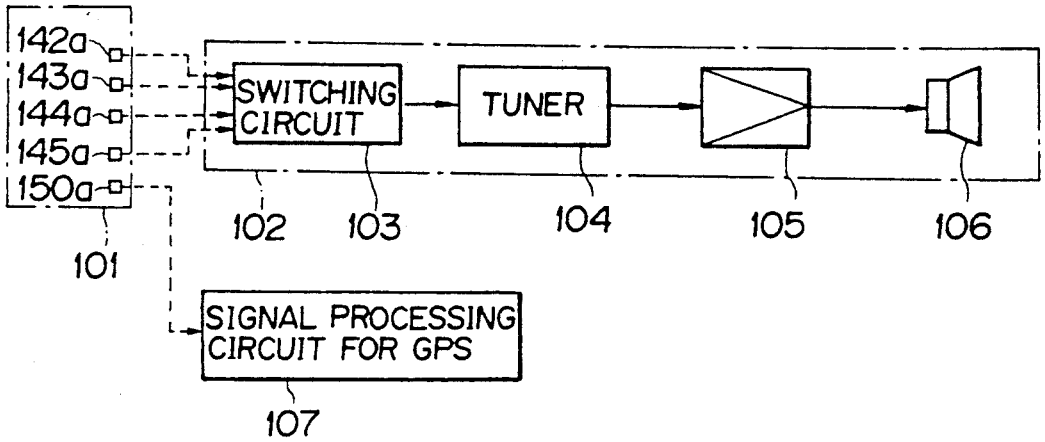
FIG. 5 is a block diagram for operation including the antenna device of FIG. 4.
Figure 6:
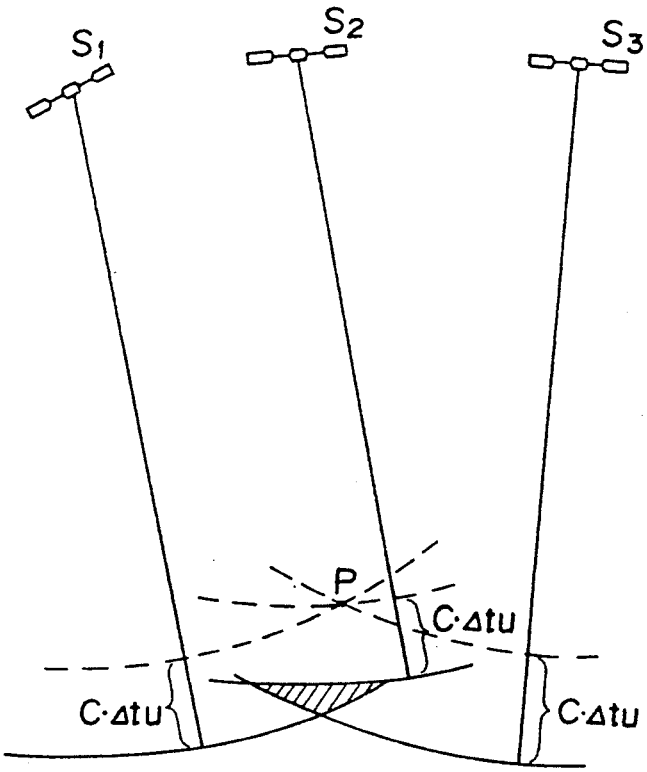
FIG. 6 is a view for the explanatory of a position measurement principle of a global positioning system to be applied to the antenna device of FIG. 4.

A second embodiment of an anttena device according to the present invention will be described hereunder with reference to FIGS. 4, 5 and 6, in which FIG. 4 is a partial perspective view of the antenna device of this embodiment, FIG. 5 is a block diagram thereof and FIG. 6 is a view showing a wave receiving principle by utilizing the satellite.

Referring to these figures, an antenna device 101 is constructed to be pertinent for the attachment to a movable body such as an automobile or a craft, automobile 140 in this embodiment. The electric wave received by the antenna device 101 is then outputted to and processed by a signal processing circuit 102 as a receiving signal. A spoiler 141 of the automobile 140 is utilized as a base member of the antenna device 101. The spoiler 141 is attached detachably to a trunk lid 140*a* of the automobile 140 with its longitudinal direction being directed horizontally. In this embodiment, instead of the defogger utilized conventionally, at least a pair of horizontal antenna elements 142 and 143 for receiving the electric wave are embedded longitudinally in the spoiler 140 with predetermined space therebetween, and at least a pair of vertical antenna elements 144 and 145 for receiving the electric wave are attached in a standing manner at portions slightly apart from the outer ends of the horizontal antenna elements 142 and 143 with predetermined space. These vertical antenna elements 144 and 145 can be accommodated as shown by two arrows A and B in grooves 146 and 147 formed longitudinally to the upper surface of the spoiler 141. Accordingly, the vertical antenna elements 144 and 145 can be accommodated in the grooves 146 and 147 when unused and set upright when used.

Electric terminal pieces 142*a*, 143*a*, 144*a* and 145*a* electrically connected respectively to the horizontal and vertical antenna elements 142, 143, 144 and 145 are secured to the end edge of the spoiler 141.

According to such structure of the antenna device 101, the electric wave received by the respective elements 142 to 145 are transmitted to a switching circuit 103 through the corresponding terminal pieces as electric signals. The switching circuit 103, after receiving the signals, operates to select ones of the horizontal and vertical antenna elements in response to the signal receiving condition. The signal selected by the switching circuit 103 is tuned by a tuner 104, amplified by an amplifier 105 and then outputted as a sound through a speaker 106.

Further, referring to FIG. 4, a reference numeral 150 denotes an antenna element for the GPS for receiving the electric wave from an artificial satellite, for example, attached to a predetermined position of the base member, and in this embodiment, a flat antenna element 150 for the GPS is embedded in a horizontal protruded portion 151 formed to the central portion of the spoiler 141. A terminal piece 150*a* for the GPS electrically connected to the anttena element 150 is attached to the spoiler 141 and the terminal piece 150*a* is also connected to a signal processing circuit 107 for the GPS.

The principle of the GPS is described hereunder. The GPS is a system for measuring distances between a plurality of artificial satellites and signal receiving points. In a theory, when the distance from one aritificial satellite is measured, the corresponding signal receiving point exists on a spherical surface of a sphere having a radius of that distance with the satellite being the center. Accordingly, when it is required to measure three dimensional position, the distances from three artificial satellites are first measured and the crossing point of the three spherical surfaces each thus obtained. In a case where the receiving point is on the earth, the position of the receiving point on the earth can be obtained by measuring the distances from two artificial satellites in accordance with the radius from the center of the earth to the receiving point.

In this regard, the distance between the satellite and the signal receiving point is obtained in the GPS by measuring the transferring time of the electric wave from the satellite. In case a clock of the satellite and a clock of a signal receiver have completely accorded with each other and the wave transferring time from the satellite has been preliminarily found, the electric wave transferring time becomes equal to the time difference between the signal sending time and the signal receiving time by measuring the electric wave receiving time. Accordingly, the distance between the satellite and the receiving point can be obtained by multipling the thus obtained transferring time to the transferring speed, i.e. light velocity, of the electric wave. However, in actual, it is considerably hard to achieve the complete coincidence of the clocks of the satellite and the receiver.

FIG. 6 is a view showing the principle for measuring the receiving points in two-dimensional manner of the GPS.

Supposing that a value $\overline{R}i'$ is obtained when a distance Ri between the satellite i (i=1, 2, 3) ($S_1$ to $S_3$ in FIG. 6) and a signal receiving point P is measured by the respective clocks of the satellite and the receiver, the value $\overline{R}i'$ will be expressed by the following equation.

$$\overline{R}i' = Ri + C\Delta tai + C(\Delta tu - \Delta svi) \quad (1)$$

where $\overline{R}i$: a true distance with respect to the satellite i,

C: a light velocity,

Δtai a wave transfer delay when the wave passes the ionized layer and the atmosphere, Δtu: clock of the receiver, and Δtsvi: offset value of the clock of the satellite i.

Among these values, Δtai is obtained by a cetain method, the offset value of an atomic clock set to each of the satellites is measured by an observation network on the earth, and the future value of the offset value is estimated, whereby the value is broadcasted from the satellite together with orbit position thereof. According to this manner, the positions of the three satellites are made clear as shown in FIG. 6 and the clocks of the three satellites show substantially the same time, and accordingly, the former equation (1) will be expressed as follows.

$$\overline{R}i = \overline{R}i' - \Delta tai + \Delta tsvi = Ri + C\,\Delta tu \quad (2)$$

Since the value $\overline{R}i$ is different from the true value by a conversion distance of the offset value of the clock of the receiver, this value is called "Pseudo Range". Referring to FIG. 6, the clock of a user is delayed by Δtu and hence the pseudo range is measured to be longer than the true value by C Δtu, which is common to the respective satellites. In a case where the true value Ri can be measured (for example, when the distance to the satellite is measured by a radar set at the receiving point P), the two-dimensional position can be determined by the two satellites, but when the pseudo range is measured, another one satellite is added for the measurement of the line, circle with constant distance, representing the third position and the value CΔtu is then adjusted to cross the three lines at one point, thus obtaining the receiving point P. This will be based on the following fact. A third unknown quantity, being an offset value of a clock of a user, exists mathematically in addition to two unknown quantities, being two dimensional positions, three measured values being thus required. Therefore, in order to measure three dimensional positions by utilizing the GPS, four satellites will be required for the two-dimensional measurement.

The GPS is developed on the basis of the above-described principle. The electric wave transmitted from the satellite is received by the flat antenna element 150 of the GPS directed substantially horizontally, and accordingly, the received signal of the electric wave is transmitted to the signal processing circuit 107 through the GPS terminal 150*a* and processed therein.

According to the antenna device of the second embodiment, a plurality of horizontal antenna elements and the flat antenna element for the GPS are attached to the base member and one of these antenna elements is selectively switched in response to the signal receiving condition. Moreover, the characteristic values of the respective antenna elements, which constitute a problem for the diversity receiving operation, can be preliminarily set, so that it is always made possible to receive the signal in good condition by selectively switching the antenna elements even if the wave condition be changed by the movement of the mavable body. Furthermore, in case of no space for the attachment of the GPS flat antenna element to the movable body, the GPS antenna element can easily be provided for the base member, which is secured to the movable body.

It may be preferred to form the vertical antenna elements of a stainless material having an elastic property to improve the stability during the high speed running of the movable body, thus achieving the good wave receiving condition.

According to the second embodiment of the present invention, since a plurality of horizontal and vertical antenna elements are also attached to the base member thereby to carry out the diversity receiving operation, and in addition, the GPS flat antenna element is attached to the base member substantially horizontally, the electric wave signal can be received in good condition in response to the condition of the electric wave. The GPS flat antenna element can be easily provided for the movable body.

A third embodiment of an antenna device according to the present invention will be described hereunder with reference to FIGS. 7, 8 and 9.

Figure 7:
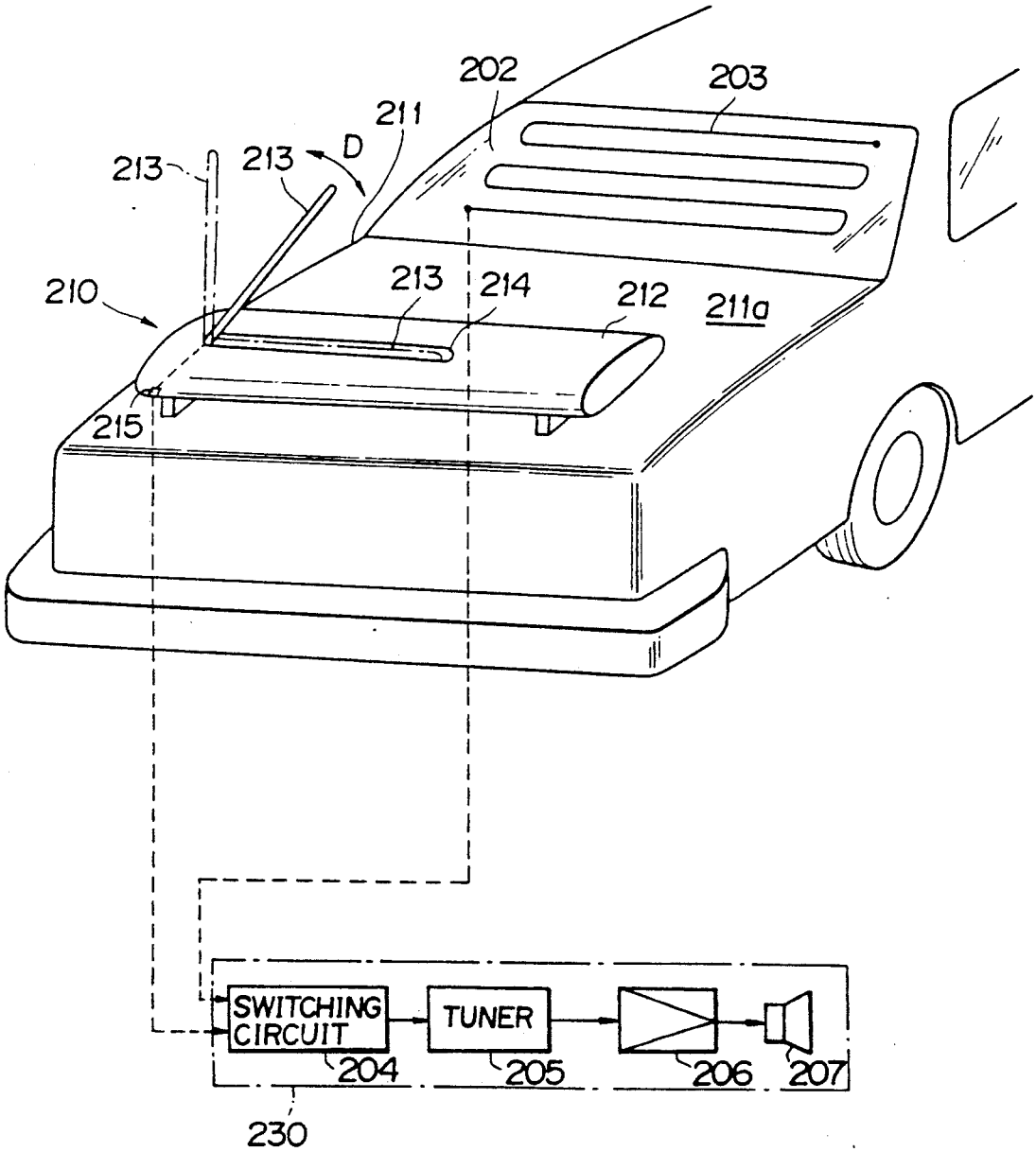
FIG. 7 shows a partial perspective view of an automobile to which a third embodiment of an antenna device according to the present invention is applied together with a block diagram for operation of the same.

Referring to FIG. 7, an antenna device 210 is constructed to be pertinent for the attachment to a movable body such as an automobile or a craft, automobile 211 in this embodiment. The electric wave received by the antenna device 210 is then outputted to and processed by a signal processing circuit 230 as a receiving signal. The antenna device 210 includes a base member 212 extending in a horizontal direction of the automobile 211, and the base member 211 is composed of, in this embodiment, by a spoiler having an outer shape suitable for generating a resistance during the running time of the automobile 211. The spoiler 212 has a rectangular shape as viewed from the upper side and detachably secured to a trunk lid 211*a* of the automobile 211.

Reference numeral 213 denotes a vertical antenna element standing substantially upright with respect to the spoiler 212 for receiving the electric wave and the vertical antenna element 213 is folded as shown by an arrow D and accommodated in a groove 214 formed to the upper surface of the spoiler 212 when unused. An electric terminal piece 215 is disposed at a side edge of the spoiler 212 and electrically connected to the vertical antenna element 213. A defogger 203 provided for a rear window 202 of the automobile 211 is utilized as a horizontal antenna element. Thus, according to this embodiment, the diversity wave receiving operation can be carried out by the vertical antenna element 213 and the defogger 203 arranged substantially horizontally.

According to such structure of the antenna device 210 of this embodiment, the electric wave received by the vertical antenna element 213 is transmitted to a switching circuit 204 of the signal processing circuit 230 through the terminal piece 215 as electric signal. To the switching circuit 204 is also connected the defogger 203 in addition to the vertical antenna element 213 so that these elements can be switched so as to selectively receive the wave in accordance with the wave condition. The wave signal selected by the switching circuit 204 is tuned by a tuner 205, amplified by an amplifier 206 and then outputted as a sound through a speaker 207.

According to the structure of the antenna device of the third embodiment, when the antenna device is not utilized such as in a parking time, the vertical antenna element can be accommodated in the groove, thus preventing the antenna element from mischievously being broken or bent and the outer appearance can be made fine. Furthermore, the spoiler 212 is utilized as the base member of the antenna device 210, so that the running stability of the automobile body can be effectively achieved during the high speed running of the automobile 211. In a certain case, substantially the same effect may be attained without utilizing the defogger 203, but in such case, the diversity receiving operation may not be expected.

Figure 8:
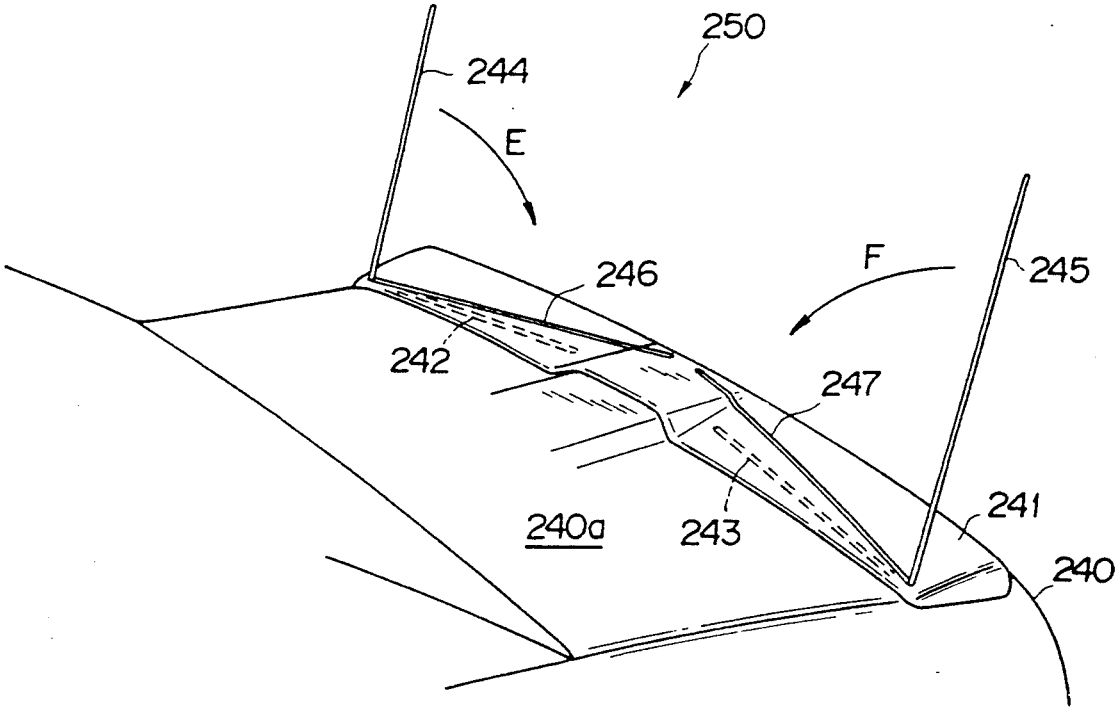
FIG. 8 is a partial perspective view of a modified example of the third embodiment shown in FIG. 7.
Figure 9:
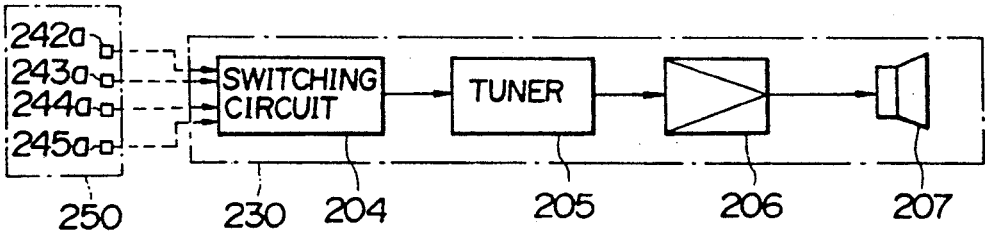
FIG. 9 is a block diagram for operation of the third embodiment.

FIGS. 8 and 9 represent an application of the third embodiment of the antenna device shown in FIG. 7, in which a pair of vertical and horizontal antenna elements are disposed to the spoiler, respectively, without utilizing the defogger. Referring to FIG. 8, at least a pair of horizontal antenna elements 242 and 243 for receiving the electric wave are embedded in a spoiler 241 attached to a trunk lid 240*a* of an automobile 240 so as to extend horizontally thereof. At least a pair of vertical antenna elements 244 and 245 for receiving the electric wave are further set upright at portions near the outer ends of the horizontal antenna elements 242 and 243. These vertical antenna elements 244 and 245 are foldable so as to be accommodated in grooves 246 and 247 formed to the upper surface of the spoiler 241. Accordingly, the vertical antenna elements 244 and 245 are folded in arrowed directions E and F and accommodated in the grooves 246 and 247 when unused, and the vertical antenna elements 244 and 245 are raised upright as shown in FIG. 8 when used.

Referring to FIG. 9, to the spoiler 241 of the antenna device 250 are attached terminal pieces 242*a*, 243*a*, 244*a* and 245*a* which are electrically connected to the horizontal and vertical antenna elements 242, 243, 244 and 245, respectively. The terminal pieces 242*a* to 245*a* are electrically connected to a switching circuit 204. Thus, according to this application, substantially the same effects as those attained by the former embodiment can be achieved. Furthermore, a plurality of vertical and horizontal elements are attached to the base member so as to be switched by the switching circuit in response to the wave receiving condition, so that the characteristic values of the respective antenna elements required at a time of diversity wave receiving can be preliminarily set to suitable values, thus receiving and transmitting the signal always in good condition by switching the antenna elements even if the condition of the electric wave be changed in accordance with the moving direction of the movable body.

It may be preferred to form the vertical antenna elements of a stainless material having an elastic property to improve the stability during the high speed moving of the movable body, thus achieving the good wave receiving condition.

According to this application of the third embodiment, since the vertical antenna elements can be accommodated in the grooves formed in the base member when unused, the vertical antenna elements, i.e. the antenna device, can be protected from being broken or bent. Since the base member, i.e. spoiler, is formed so as to have an outer shape suitable for generating resistance during the running time of the automobile, the stability of the automobile body can be achieved.

Figure 10:
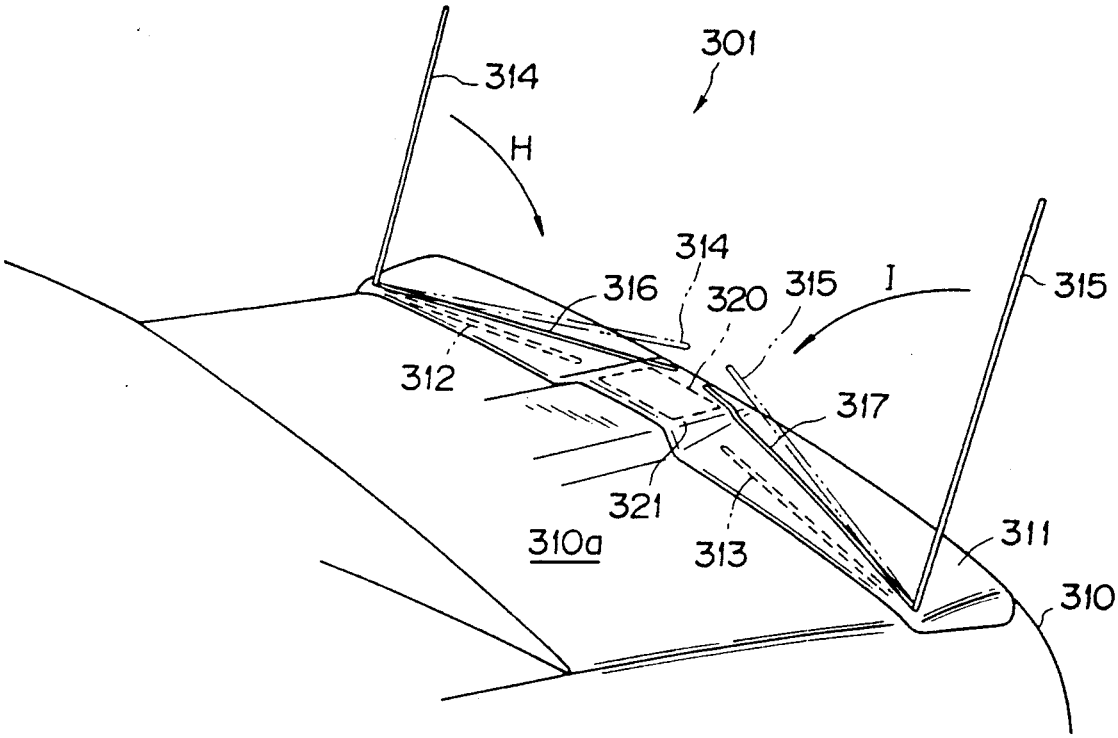
FIG. 10 is a view similar to that of FIG. 3 or 4, representing a fourth embodiment of an antenna device according to the present invention.

FIGS. 10 to 16 represent a fourth embodiment of an antenna device according to the present invention, in which FIG. 10 is a partial perspective view of an antenna device according to this embodiment. Referring to FIG. 10, an antenna device 301 is constructed to be pertinent for the attachment to a movable body such as an automobile or a craft, automobile 310 in this embodiment. The electric wave received by the antenna device 301 is then outputted to and processed by a signal processing circuit 302 as a receiving signal. The antenna device 301 includes a base member extending in a horizontal direction of the automobile 310 and the base member is composed of, in this embodiment, by a spoiler 311 having non-conductive property and the spoiler 311 has a rectangular shape as viewed from the upper side and detachably secured to a trunk lid 310*a* of the automobile 310. According to this embodiment, at least a pair of horizontal antenna elements 312 and 313 for receiving electric wave are embedded in the upper surface of the spoiler 311 instead of the defogger conventionally utilized and the horizontal antenna elements 312 and 313 extend in substantially the horizontal direction of the automobile 310 with a slight space therebetween. At least a pair of vertical antenna elements 314 and 315 for receiving the electric wave are also disposed in a standing manner to the spoiler 311 at portions near the outer ends of the respective horizontal antenna elements 312 and 313. The vertical antenna elements 314 and 315 are foldable and accommodated as shown by two arrows H and I in grooves 316 and 317 formed in the upper surface of the spoiler 311 when unused and the vertical antenna elements 314 and 315 are raised upright when used as shown in FIG. 10. Electric terminal pieces 312*a*, 313*a*, 314*a* and 315*a* are disposed at a side edge of the spoiler 311 and electrically connected to the horizontal and vertical antenna elements 312, 313, 314 and 315, respectively. The terminal pieces 312*a*, 313*a*, 314*a* and 315*a* are also electrically connected to a switching circuit 303, which selectively switches the horizontal and vertical antenna elements in response to the signal receiving condition of the antenna device 301.

According to such structure of the antenna device 301 of this embodiment, the signal selected by the switching circuit 303 is tuned by a tuner 304, amplified by an amplifier 305 and then outputted as a sound through a speaker 306.

Figure 11:
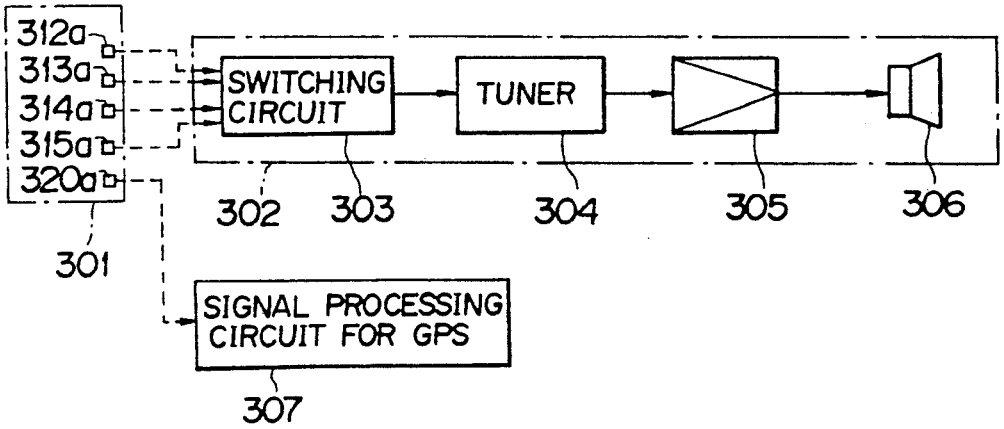
FIG. 11 is a block diagram for operation for the fourth embodiment of FIG. 10.

Further referring to FIG. 10, reference numeral 320 denotes a flat antenna element for the GPS attached substantially horizontally to a predetermined position of the base member, and in this embodiment, the antenna element 320 is embedded in a protruded portion 321 horizontally formed at the central portion of the spoiler 311. As shown in FIG. 11, a terminal piece 320*a* to be electrically connected to the flat antenna element 320 for the GPS is attached to the side edge of the spoiler 311 and the terminal piece 320*a* is also electrically connected to the GPS signal processing circuit 307.

Figure 12:
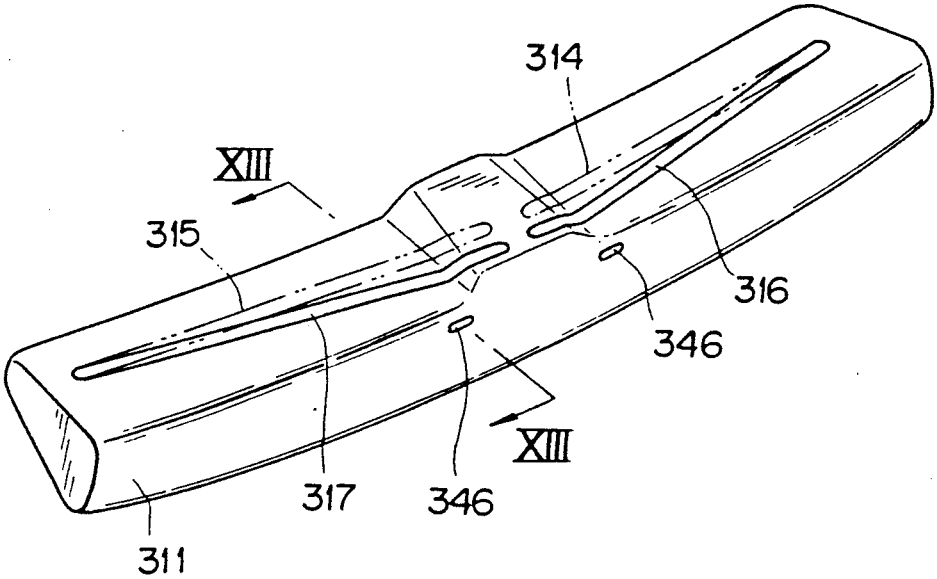
FIG. 12 is a perspective view of the antenna device of the fourth embodiment.
Figure 13:
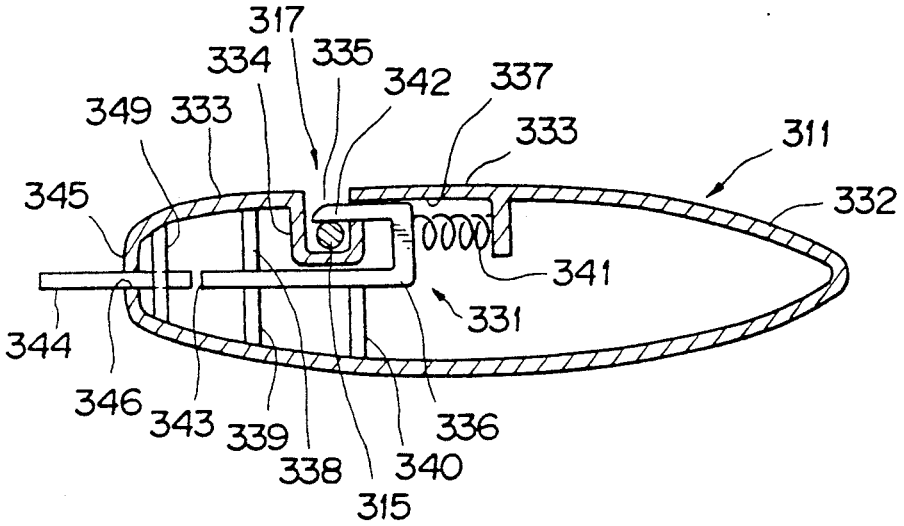
FIG. 13 is a sectional view taken along the line XIII—XIII of FIG. 12.
Figure 14:
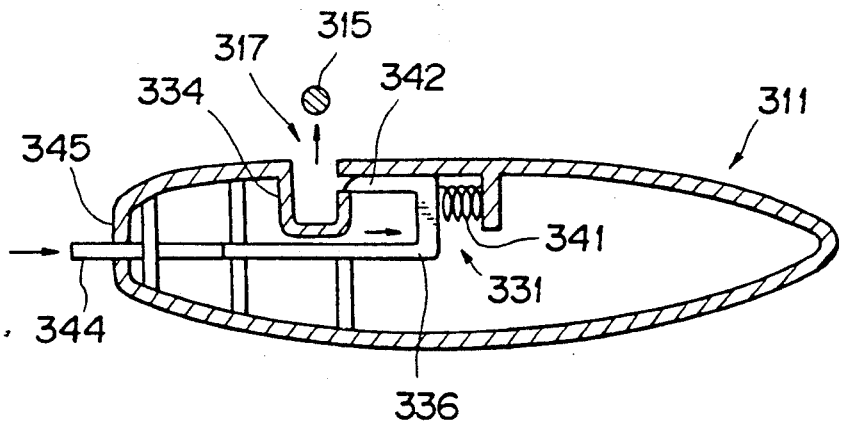
FIG. 14 is a sectional view similar to that of FIG. 13 for the explanatory of the operation of the antenna device of the fourth embodiment.

FIG. 12 is a perspective view representing the spoiler 311 and FIGS. 13 and 14 are sectional views taken along the line XIII—XIII of FIG. 12 for showing an engaging mechanism for engaging the vertical antenna element. Referring to these figures, the grooves 316 and 317 formed in the spoiler 311 each has a courved configuration so that both the longitudinal ends of the groove are positioned slightly lower, in the attached condition, than the central portion thereof. Each of the vertical antenna elements 314 and 315 has a flexible property and takes a linear shape when the same is not subjected to any external force. Accordingly, when the vertical antenna elements 314 and 315 are fallen down into the grooves 316 and 317, as shown by chain lines in FIG. 12, the vertical antenna elements 314 and 315 have linearly extending attitude in case of receiving no external force, and hence, the front ends thereof are not positioned in the corresponding grooves 316 and 317 because of the curved configurations of the grooves. For this reason, according to this embodiment, a pair of engaging mechanisms 331 for engaging the vertical antenna elements 314 and 315 in flexed state are provided for the spoiler 311, each of the engaging mechanisms 331 being located at bilateral one end of the spoiler 311.

Figure 15:
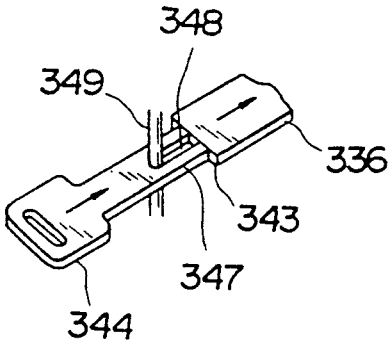
FIG. 15 is a partial perspective view of the antenna device of fourth embodiment, in which a key is inserted.

Referring to FIG. 13, showing the engaging mechanism 331 for the vertical antenna element 315, for example. The spoiler 311 is composed of a hollow casing 322 having an upper surface 333 to which the groove 317 is formed. A U-shaped member 334 is secured integrally to the rear surface side of the upper portion 333 so as to extend in the groove 317 in the longitudinal direction thereof and the upper portion of the U-shaped member 334 is formed as an opening 335. As described hereinbefore, the U-shaped member 334 is also bent so that the longitudinal end portions thereof is positioned slightly lower than the central portion thereof. An engaging member 336 for engaging the front end portion of the vertical antenna element 315 is disposed in the casing 332 in such a manner that the vertical, as viewed, movement of the engaging member 336 is limited in the casing 332 by the inner surface 337 of the casing and support members 338, 339 and 340 secured in the casing 332, but the engaging member 336 is slidable in the bilateral direction as viewed. The engaging member 336 is urged leftwardly by an elastic member, i.e. spring 341. According to these structures, the opening 335 of the groove 317 is closed by an upper lefthand end portion 342 of the engaging member 336, thus holding the vertical antenna element 315 as being accommodated in the U-shaped member 334. The vertical antenna element 315 may be smoothly forced into the groove 317 by a finger from the upper side by providing a tapered portion formed to the upper lefthand end portion 342. The engaging member 336 is slid in the righthand direction, as viewed, against the spring force of the spring 341 by pressing the lefthand end portion of the engaging member 336 by a key 344 as a pressing member. The key 344 is utilized for releasing the engagement of the vertical antenna element 315 in the groove 317 thereby to raise upright the vertical antenna element 315, and the key 344 may have a shape capable of being plugged into a key hole 346 formed to the rear surface 345 of the casing 332. The key 344, as shown in FIG. 15, may be provided with a cutout 348 as a slit groove at a front end portion 347 abutting against the lefthand end portion 343 of the engaging member 336. The cutout groove 348 is engaged, when the key 344 is inserted into the key hole 346, with a round rod 349 positioned inside the casing 332 so that the cutout groove 348 slides along the round rod 349. The structure capable of engaging the cutout groove 348 and the round rod 349 is made for the purpose of preventing any foreign material from being inserted into the key hole 346 to erroneously disengage the vertical antenna element 315 from the groove 317. Namely, according to this structure, when a certain thing is mischievously inserted into the key hole 346, the advance of the thing into the key hole 346 is prevented by the location of the round rod 349 thereby not to slide the engaging member 336.

The vertical antenna elements, one 315, for example, are operated in the following manner.

When unused, the vertical antenna element 315 now standing upright as shown in FIG. 10 is fallen down as shown by the arrow I so as to take a linearly extending position as shown in FIG. 12 by a chain line, and then, the front end side of the vertical antenna element 315 is pressed downward by a finger into the groove 317. The tapered portion formed to the upper lefthand end 342 of the engaging member 336 is forced downward and, hence, the engaging member 336 is slid rightward, as viewed, against the spring force of the spring 341 and temporarily release the opening 335 of the groove 317. Accordingly, the vertical antenna element 315 is accommodated in the groove 317 in a flexed manner and the engaging member 336 is slid leftward by the spring force of the spring 341 thereby to tightly hold the flexed vertical antenna element 315 to a portion below the upper lefthand end portion 342 in a state such as shown in FIG. 13.

When the vertical antenna element 315 is utilized, the key 344 is inserted into the key hole 346 formed in the rear surface of the spoiler 311. Then, the key 344 is moved rightward, as viewed in FIG. 13, by the slidable engagement of the cutout groove 348 with the round rod 349, whereby the engaging member 336 is pushed rightward and slid further rightward against the urging force of the spring 341, thus disengaging the vertical antenna element 315 from the upper lefthand portion of the engaging member 336, and as shown in FIG. 14, the vertical antenna element 315 is flown out outwardly of the groove 317 by the self-restitutive force. The vertical antenna element 315 is set upright with respect to the spoiler 311 for the practical use. The engaging member 336 returns its original position by drawing the key out of the key hole 346.

Accordingly, when the vertical antenna elements are not used, particularly at a parking time of the automobile, they are prevented from being broken or bent, and since the vertical antenna elements are accommodated in the grooves formed in the spoiler, the outer appearance is also made fine. Furthermore, the spoiler of the automobile is utilized for the base member of the antenna elements, so that the running stability of the automobile during the high speed running can be effectively maintained.

Moreover, according to the present embodiment, a plurality of horizontal and vertical antenna elements 312, 313, 314 and 315 are attached to the spoiler 311 so as to be switched in response to the electric wave receiving condition and the antenna characteristic values for the diversity receiving process can be preliminarily set, so that the good wave receiving condition can be always achieved by selectively switching either one of horizontal and vertical antenna elements even if the wave condition be changed in accordance with the movement of the automobile.

Since the vertical antenna elements have elastic property, so that the stability thereof during the high speed running of the automobile 310 can be improved, thus maintaining the good wave receiving condition.

Figure 16:
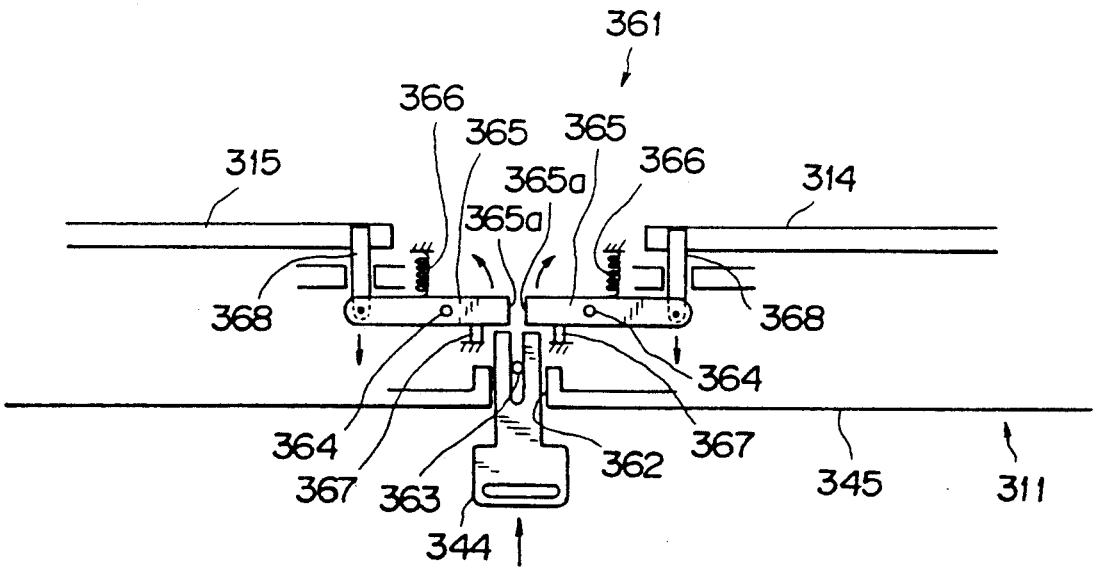
FIG. 16 is a partial plan view of a modified example of the fourth embodiment.

FIG. 16 shows a structure, in a plan view, of a modified example of the fourth embodiment, in which there is provided an engaging member 361 for engaging the vertical antenna elements 314 and 315 in a flexed manner in the grooves of the spoiler. The vertical antenna elements are of course flown out by disengaging them from the engaging member 361. Referring to FIG. 16, a key hole 362 of substantially the same character as that of the key 344 of the fourth embodiment is formed in the rear surface of the spoiler 311 and a round bar 363 is also disposed in the engaging member 361 for slidably guiding the key 344. Bilaterally symmetric mechanisms are located in the spoiler 311, and the mechanisms include axes 364 secured to the casing and levers 365 are mounted around the axes to be rotatable. The lefthand lever 365 is urged to be rotatable in the clockwise direction and the righthand lever 365 is also urged to be rotatable in a counter-clockwise direction by tension springs 366, respectively. The rotations of these levers 365 are limited by stopper elements 367 secured to an outer casing of the spoiler. To the outer end of each lever 365 is connected an engaging piece 368 so as to be slidable in a vertical, as viewed, direction in accordance with the rotation of the lever 365. The respective levers 365 have inner end portions 365*a* opposing to each other, which are pressed simultaneously inwardly by the key 344 inserted into the casing of the spoiler through the key hole 362. The upper end of the engaging piece 368 supports each of the vertical antenna elements 314 and 315 to be disengageable from the groove of the spoiler 311. FIG. 16 shows a state in which the vertical antenna elements 314 and 315 are accommodated in the grooves of the spoiler 311, and the antenna elements 314 and 315 are flown out of the grooves by inserting the key 344 into the key hole 362 thereby to press upwardly, as viewed, the inner end portions 365*a* of the levers 365. The levers 365 is then rotated around the axes 364 in arrowed directions, thereby downwardly moving the engaging pieces 368, respectively. According to this operation, the engagement between the engaging pieces 368 and the vertical antenna elements 314 and 315 is released and the antenna elements 314 and 315 are flown out from the grooves by the self-restitutive force. As described, the vertical antenna elements 314 and 315 are both simultaneously flown out from the grooves by the one touch operation of the key 344, thus improving the workability and the operability.

As described hereinbefore, according to the present invention, since the vertical antenna elements can be accommodated in the grooves formed in the base member such as spoiler of the automobile to be disengageable by the engaging members, the vertical antenna elements can be prevented from being broken or bent particularly at a parking time of the automobile. Moreover, since the vertical antenna elements are made of a flexible material, the vibration and the like caused by the vibration of the movable body can be effectively absorbed, thus surely accommodating the antenna elements in the grooves.

Furthermore, according to the first to fourth embodiments of the present invention, the antenna device is constructed as one structure, so that the degradation of the performance, which may be caused by the attachment of the antenna device to the movable body, can be minimumly reduced and the antenna device can be easily attached to the movable body.

The antenna device can receive long waves, short waves for a usual correspondence and the GPS, and waves for AM and FM broadcasts and television system. The antenna device may be utilized as an electric wave generation system, thus utilizing for the correspondence between the movable bodies.

The number of the horizontal and vertical antenna elements is not limited to two and three or more elements may be utilized for further improving the wave receiving condition.

It is to be understood that the present invention is not limited to the described embodiments and many other changes and modifications may be made without departing from the scopes of the appended claims. For example, when the antenna device is attached to an automobile, the antenna device may be directly attached to the rear portion such as trunk lid of the automobile by forming grooves for accommodating the vertical antenna element to the upper surface of the trunk lid, for example.

What is claimed is:

1. An antenna device for a movable body comprising:

a base member to be attached substantially horizontally to the movable body;

a plurality of horizontal antenna elements for receiving electric wave attached horizontally to said base member and separated with each other by a predetermined distance;

a plurality of vertical antenna elements for receiving electric wave attached upright to the base member and separated with each other by a predetermined distance;

electric terminal means attached to said base member and electrically connected to said horizontal and vertical antenna elements, respectively; and a switching circuit means electrically connected to said terminal means for selectively switching ones of said vertical and horizontal antenna elements.

2. An antenna device according to claim 1, wherein said movable body is an automobile and said base member is a spoiler attached horizontally to a rear portion of an automobile body and wherein said horizontal antenna elements are embedded in said spoiler so as to extend in a longitudinal direction thereof and said vertical antenna elements are secured to said spoiler at portions near outer end portions of said horizontal antenna elements.

3. An antenna device according to claim 2, wherein said spoiler is provided with grooves on an upper surface thereof each having a shape suitable for accommodating each vertical antenna element when unused.

4. An antenna device according to claim 3, wherein said vertical antenna elements each is formed of an elastic material.

5. An antenna device according to claim 4, wherein said elastic material is a stainless material.

6. An antenna device according to claim 1, further comprising an antenna element for a global positioning system for receiving electric wave attached to said base member so as to extend substantially horizontally and an electric terminal means secured to said base member and connected to said antenna element for the global positioning system.

7. An antenna device according to claim 6, wherein said base member to which the vertical antenna elements are attached is a spoiler attached substantially horizontally to a rear portion of an automobile body, said spoiler being provided with a horizontal protruded portion formed at substantially a central portion of said spoiler, said antenna element for the global positioning system being embedded in said protruded portion of the spoiler.

8. An antenna device according to claim 7, wherein said spoiler is provided with grooves on an upper surface thereof each having a shape suitable for accommodating each vertical antenna element when unused.

9. An antenna device according to claim 8, wherein said vertical antenna elements each is formed of an elastic material.

10. An antenna device for a movable body comprising:

an aerodynamic spoiler to be attached substantially horizontally at a rear portion of the movable body, said aerodynamic spoiler being formed from a non-conductive material and being provided with a groove means in an upper surface thereof;

a vertical antenna element for receiving electric waves, attached to the aerodynamic spoiler and accommodated in said groove means when unused; and an electric terminal means attached to said aerodynamic spoiler and electrically connected to said vertical antenna element.

11. An antenna device according to claim 10, wherein said movable body is an automobile.

12. An antenna device according to claim 10, wherein said movable body is an automobile provided with a rear window to which is mounted a defogger acting as a horizontal antenna element for receiving electric wave and wherein said antenna device further comprises a switching circuit means electrically connected to said vertical antenna element and said defogger for selectively switching one of said vertical antenna element and said defogger in response to electric wave receiving condition.

13. An antenna element according to claim 10, wherein said vertical antenna element is formed from a flexible material and wherein an engaging means for engaging said vertical element, when said vertical antenna element is accommodated in said groove means, is disposed in said groove means.

14. An antenna device according to claim 13, wherein said aerodynamic spoiler is attached to an automobile body and wherein said vertical antenna element comprises a pair of antenna element parts extending linearly straight at a time of receiving no external force and said groove means is composed of a pair of grooves formed to the aerodynamic spoiler at portions corresponding to said vertical antenna element parts when accommodated therein, each of said grooves having both longitudinal ends positioned in a level lower than that of a central portion thereof so as to provide a curved shape, said engaging means comprising two engaging mechanisms being disposed in said grooves, respectively.

15. An antenna device according to claim 14, wherein each of said engaging mechanisms comprises a U-shaped outer portion constituting a portion of said groove and secured to a rear side of an upper surface of said aerodynamic spoiler, an engaging member disposed in said aerodynamic spoiler for engaging a front end portion of said vertical element part fallen down in said U-shaped portion in a disengageable manner, means for limiting a vertical movement of said engaging member and allowing the engaging member to move in a direction substantially normal to the vertical antenna element part, and means for urging said engaging member in a direction to close the portion of said groove.

16. An antenna device according to claim 15, wherein said aerodynamic spoiler is provided with a pair of key holes and each of said engaging mechanism is further provided with a pushing member which is inserted into said key hole thereby to push and slide said engaging member disposed in said aerodynamic spoiler.

17. An antenna device according to claim 16, wherein a rod member is disposed in said aerodynamic spoiler at a portion between said key hole and said engaging member and wherein said pushing member is a key member provided with a cutout groove at a front end portion thereof, said key member being slidably inserted into said key hole with said rod member sliding along said cutout groove.

18. An antenna device according to claim 16, further comprising a pair of axes mounted inside of the aerodynamic spoiler, a pair of lever members mounted to said axes to be rotatable thereabout, said lever members having one ends connected to said engaging members and other ends opposing closely each other and both being pushed by said pushing means, a pair of spring means for urging said lever members so as to move said engaging members in a direction closing the portion of said groove, and a pair of stopper members disposed inside of the aerodynamic spoiler for limiting rotations of said lever members, respectively.

19. An antenna device according to claim 14, further comprises a pair of horizontal antenna elements for receiving electric wave embedded in said aerodynamic spoiler so as to extend longitudinally horizontally with respect to the aerodynamic spoiler and separated from each other with a predetermined distance, said horizontal antenna elements being arranged inside of attaching positions of said vertical antenna elements to the aerodynamic spoiler, a terminal means secured to said aerodynamic spoiler and electrically connected to said horizontal antenna elements, and a switching circuit means electrically connected to said terminal means for said vertical and horizontal antenna elements so as to selectively switch ones of said vertical and horizontal antenna elements in response to a wave receiving condition.

20. An antenna device according to claim 19, further comprises an antenna element for a global positioning system for receiving electric wave embedded in substantially a central portion of said aerodynamic spoiler so as to extend horizontally with respect to a ground of the earth and a terminal means secured to said aerodynamic spoiler and electrically connected to said antenna element for the global positioning system.

21. An antenna device for an automobile provided with a trunk lid, comprising:

a spoiler of non-conductive property attached horizontally to the trunk lid of the automobile, said spoiler being provided with a pair of grooves formed to an upper surface thereof, each of said groove having both longitudinal end portions in a level lower than that of a central portion thereof so as to provide a curved shape;

a pair of horizontal antenna elements for receiving electric wave embedded in said spoiler so as to extend longitudinally horizontally with respect to said spoiler:

a pair of vertical antenna elements for receiving an electric wave attached upright to said spoiler at portions near outer ends of said embedded horizontal antenna elements, said vertical antenna elements being accommodated in said grooves formed to said spoiler when unused, each of said vertical antenna elements having a flexible property so as to provide a linearly straight shape at a time of receiving no external force;

a pair of engaging mechanisms each being disposed in each of said grooves for engaging said vertical antenna element in a flexed manner in a disengageable manner, each of said engaging mechanisms comprising a U-shaped outer portion constituting a portion of said groove and secured to a rear side of an upper surface of said spoiler, an engaging member disposed in said spoiler for engaging a front end portion of said vertical element fallen down in said U-shaped portion in a disengageable manner, means for limiting a vertical movement of said engaging member and allowing the engaging member to move in a direction substantially normal to the vertical antenna element by inserting a pushing means into a key hole provided for the spoiler, and means for urging said engaging member in a direction to close the portion of said groove;

a terminal means secured to said spoiler and electrically connected to said horizontal and vertical antenna elements;

an antenna element for a global positioning system for receiving electric wave embedded in substantially a central portion of said spoiler so as to extend horizontally with respect to a ground of the earth;

a terminal means secured to said spoiler and electrically connected to said antenna element for the global positioning system; and a switching cicuit means electrically connected to said terminal means for selectively switching ones of said horizontal and vertical antenna elements in response to wave receiving condition.

* * * * *